US006460581B1

(12) United States Patent
Marshall et al.

(10) Patent No.: US 6,460,581 B1
(45) Date of Patent: Oct. 8, 2002

(54) WALL HOPPER

(76) Inventors: Kenneth Gene Marshall, 2353 N. Kellogg Ct., Altadena, CA (US) 91001; David Prom Smith, 2353 N. Kellogg Ct., Altadena, CA (US) 91001

( * ) Notice: Subject to any disclaimer, the term of this patent is extended or adjusted under 35 U.S.C. 154(b) by 0 days.

(21) Appl. No.: 09/840,605

(22) Filed: Apr. 23, 2001

(51) Int. Cl.[7] ..... B65B 39/00
(52) U.S. Cl. ..... 141/337; 141/331; 141/340
(58) Field of Search ..... 141/337, 338, 141/331, 339, 340, 316, 391; 52/742.13, 742.14; 248/99, 100

(56) References Cited

U.S. PATENT DOCUMENTS

| | | | |
|---|---|---|---|
| 1,833,582 | * | 11/1931 | Kavanagh |
| 2,683,981 | * | 7/1954 | Richey |
| 2,940,298 | * | 6/1960 | Joseph |
| 3,545,159 | * | 12/1970 | Brewer |
| 3,764,222 | * | 10/1973 | Orthman |
| 3,791,559 | * | 2/1974 | Foye |
| 3,887,114 | * | 6/1975 | Villanovich |
| 3,999,920 | * | 12/1976 | Cerillo, Jr. |
| 4,135,651 | * | 1/1979 | Hession et al. |
| 4,830,594 | * | 5/1989 | Dawson |
| 5,114,040 | * | 5/1992 | Brenish et al. |
| 5,348,204 | * | 9/1994 | Acedo |
| 5,732,753 | * | 3/1998 | Danzi et al. |

* cited by examiner

*Primary Examiner*—Gregory L. Huson
*Assistant Examiner*—Khoa Huynh

(57) ABSTRACT

A concrete wall hopper comprising: a front board having hook tabs, a rear board having hook tabs, two sideboards having slots capable of receiving the hook tabs to allow firm connection between the front board, rear board and two sideboards when the slots receive the hook tabs, wherein each of two sideboards forms a notch at the bottom of the sideboard, the notches shaped to receive and straddle the top of a wall, wherein the front board and the rear board form an angle less than 90 degrees capable of funneling concrete flow into the hollow portion of a wall, wherein the notches can screed concrete at the height of the wall when a user moves the hopper along the wall.

8 Claims, 3 Drawing Sheets

WALL HOPPER

FIELD OF INVENTION

The invention relates to a hopper for efficiently diverting materials such as concrete into the hollows of a wall.

LIST OF REFERENCES CITED

| Inventor | Number | Class | Issue Date |
|---|---|---|---|
| Danzi | 5,732,753 | 141/340 | 3/31/1998 |
| Hedrickson | 5,868,180 | 141/340 | 2/9/1999 |

BACKGROUND DISCUSSION OF RELATED ART

When building a cinder block wall, various cells need to be filled with concrete. Often times, rebar steel reinforcement beams must be placed within the cells of a cinder block wall to strengthen the wall. Without concrete, a cinder block wall can be easily broken.

For large projects, construction workers usually fill concrete walls by mixing concrete in a concrete mixer and then pouring the concrete from a chute into the cells of a wall. For small projects, concrete is mixed in a bucket, which is used to pour the concrete into the cells of the wall.

Several devices have attempted to expedite the pouring of concrete into the cells of a wall. The Hedrickson device U.S. Pat. No. 5,868,180, issued Feb. 9, 1999 is entitled Concrete form splash funnel. The Hedrickson funnel is shaped to pour concrete into a wall. The funnel is placed with the mouth inside the wall to allow a user to pour concrete into the wall. The Deye funnel must be removed and placed in every set of cells that need to be filled. It does not allow a user to pour concrete and rod the concrete at the same time. The term rod is the industry term for screed. The Hedrickson device is a low cost funnel for directing the flow of fluid concrete to the form for a concrete wall or a concrete block wall. The funnel can be unitary and of plastic. Further, the funnels can be nested with each other for ease of storage and cost of transportation.

For larger walls, Danzi U.S. Pat. No. 5,732,753, 141/340 (issued Mar. 3, 1998 uses a funnel system. The Danzi device is a cylindrical hopper with a funnel that slidably engages the upper edges of a pair of spaced form walls. While the Danzi device allows wall filling on a continuous basis, but requires many parts and is better suited for large projects.

DESCRIPTION OF THE PREFERRED EMBODIMENT

Figure 1:
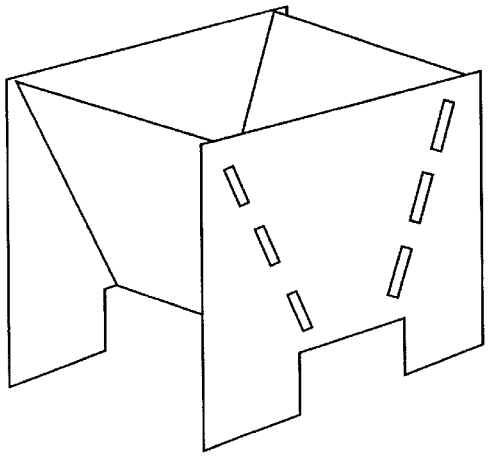
FIG. 1 is a drawing of the wall hopper
Figure 4:
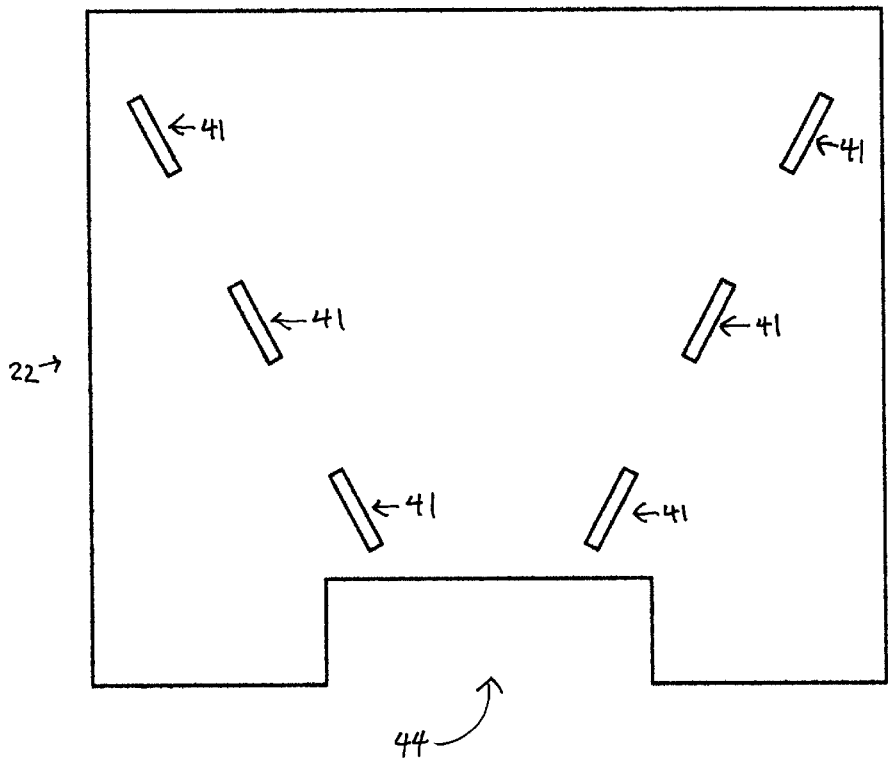
FIG. 4 is a drawing of a sideboard
Figure 3:
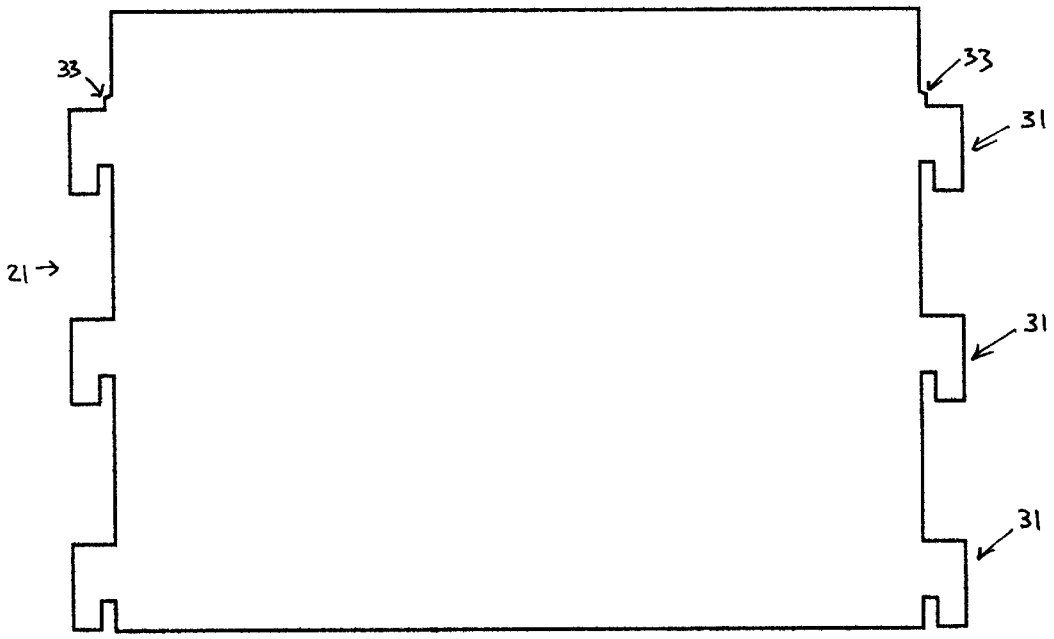
FIG. 3 is a drawing of a front or rear board

The invention is comprised of four planar elements that assemble to form a funnel capable of guiding poured concrete into the cells of a wall. The preferred embodiment is seen in FIG. 1.

Figure 2:
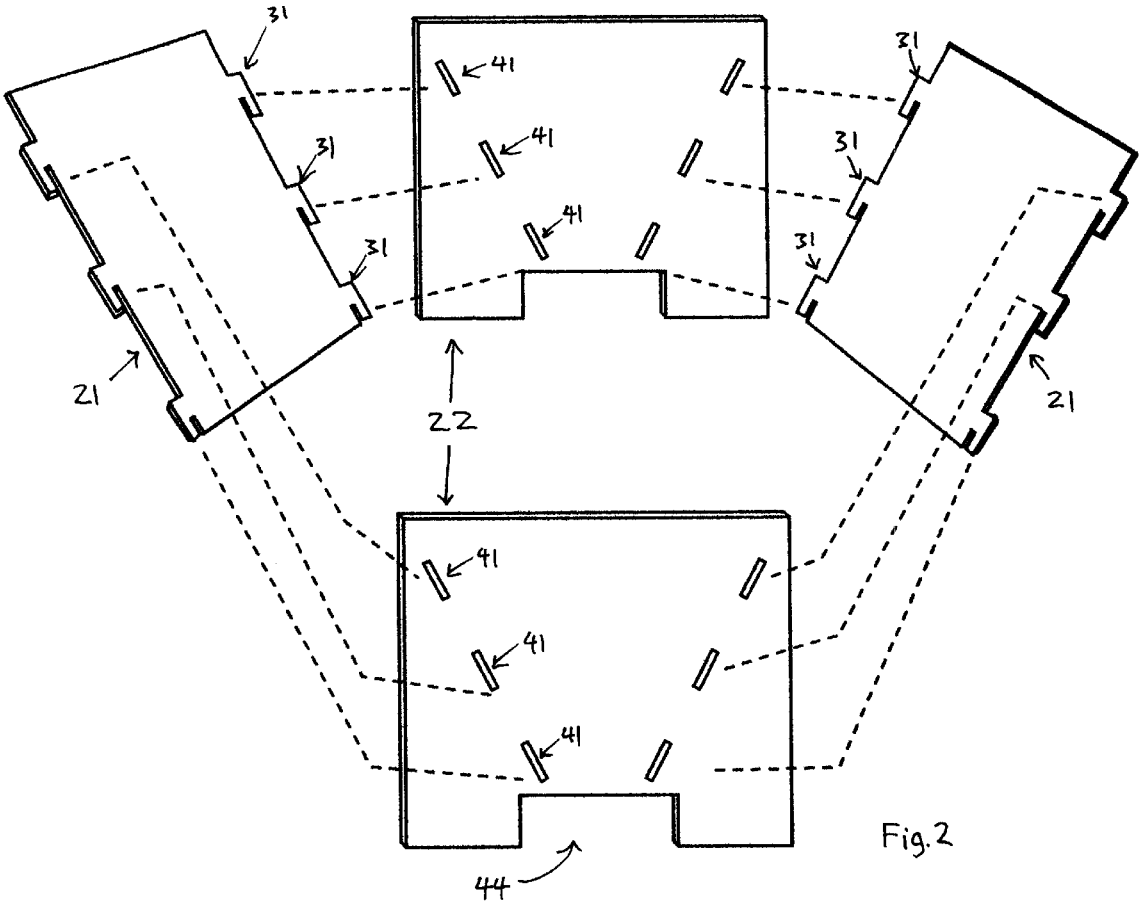
FIG. 2 is an exploded view showing assembly of the wall hopper

The planar elements are preferably constructed of standard hard board of quarter inch thickness as seen in FIG. 2. Although they can be made from plastic, metal, wood or other materials, standard hard board is much less expensive and provides essentially the same function.

The front board 21 and rear board 21 are joined on both sides by two sideboards 22. The front board 21 and rear board 21 are preferably identical to allow ease in manufacturing. The two sideboards 22 are also preferably identical to allow ease in manufacturing. The front board can have a plurality of hook tabs 31 that protrude from the board on both sides. The hook tabs 31 can enter slots 41 in the sideboard 22 to allow a connection with the sideboard 22. The rear board can likewise have the same tabs that connect to the slots on the sideboards 22.

The front and rear boards 21 form an angle. The best mode of the angle is less than 90 degrees. The angle allows structural rigidity and improved concrete flow. An alternative embodiment includes additional set of slots, similar to slots 41, located on the sideboards 22. The additional slots are placed either on the left or right of slots 41. The additional slots can allow the user to adjust the angle formed between the front and rear board. The adjustable angle allows a user to better control concrete flow. The additional slots can also allow the device to be used on differently sized walls. Having more than one set of slots may allow concrete to flow out of the slots. To inhibit the leak, small plugs may be used.

Once the four boards are connected, a nub 33 on the hook tab 31 allows the boards a more rigid connection by locking the hook tabs 31 in place. Not all hook tabs 31 need nubs 33, for that could make the locking of the hook tabs 31 difficult. To lock a hook tab 31 having a nub 33 in place, a user may have to bend the sideboard slightly.

The front board 21 and rear board 21 are most easily made as a rectangular planar element. The sideboards should also be essentially rectangular and form a rectangular notch on the bottom side. The rectangular notch 44 should be in the shape of the top of the wall that the funnel is designed to accommodate. Many walls in the United States are made from what is commonly termed 6" or 8" blocks. The blocks commonly called 6" or 8" blocks may not be exactly 6" or 8" in width but do have some easily determined standardized size of approximately 6" or 8" in width.

Figure 5:
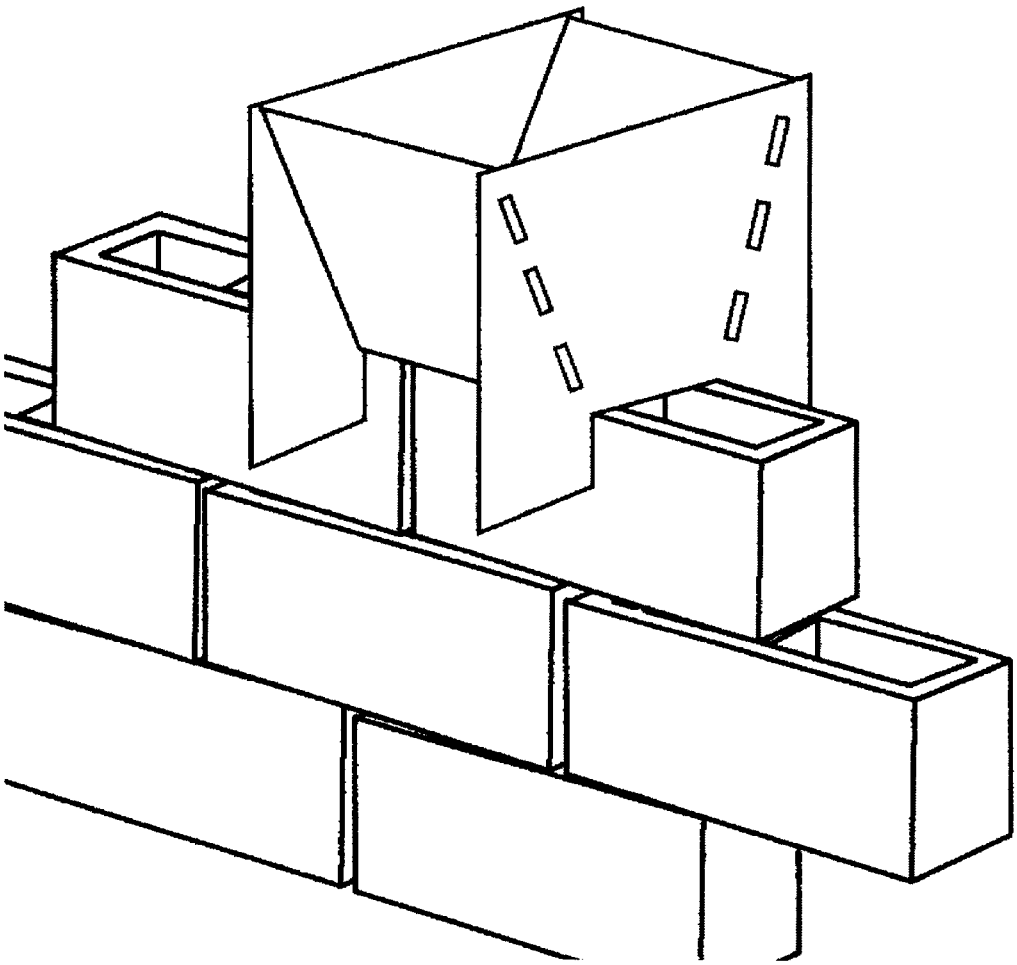
FIG. 5 is a drawing of the wall hopper straddled upon a wall

The notches in both sideboards allow the funnel to straddle the wall as seen in FIG. 5. The front and rear boards are aligned to so that their bottom edges cover the top exposed surface of the cinder block wall. The front and rear board do not form a gap with the top exposed surface of the cinder block; and thus not allowing the leakage of concrete.

A user pours concrete into the funnel and slides the funnel along the top of the wall. The funnel rods or screeds the concrete at the height of the wall by scraping excess concrete into the next cell. After use, the funnel can be disassembled and rinsed for further use. It can also be disposable due to its low cost and environmentally friendly construction.

The entire funnel can be made of four pieces of hardboard that stack together to have a height of only one inch. This conserves more space than the traditional unitary plastic funnels that can only nest together.

The operation of the assembled wall hopper is simple. A user places the hopper on the wall as seen if FIG. 5. The user fills the hopper with concrete. The user slides the hopper to the next block of empty cells. This will rod/screed the concrete at the height of the top of the wall and also move the excess concrete into the next block. When the wall is complete, a user can discard the hopper or rinse it for further use. The hopper can be disassembled after use.

What is claimed is:

1. A concrete wall hopper comprising:

a front board having hook tabs disposed on both sides, a rear board having hook tabs disposed on both sides, two sideboards, each of said sideboards having slots receiving said hook tabs allowing firm connection between said front board, said rear board and said two sideboards when said slots receiving said hook tabs, wherein said each of said two sideboards forms a notch at a bottom of the sideboard, said notches having a shape that allows the hopper receives and straddles a tope of a wall, wherein said front board and said rear board form an angle less than 90 degrees allowing concrete funneling into a hollow portion of the wall, wherein said notch screed concrete at a height of the wall when a user moves said hopper along the wall.

2. The hopper as in claim 1, further comprising a nub formed on at least one hook tab of said hook tabs, wherein said nub allowing said at least one hook tab to lock into a slot of said slots, whereby unintentional disassembly is discouraged.

3. The hopper as in claim 2, wherein said front board and said rear board are interchangeably similar.

4. The hopper as in claim 2, wherein said two sideboards are interchangeably similar.

5. The hopper as in claim 2, wherein said notches are adapted for an eight inch thick wall.

6. The hopper as in claim 2, wherein said notches are adapted for a six inch thick wall.

7. The hopper as in claim 2, wherein said front board, said rear board and two sideboards are constructed of quarter inch hardboard.

8. The hopper as in claim 2, wherein said slots are configured in several sets to allow various angles to be formed between the front board and rear board.

* * * * *